US007275957B1

(12) United States Patent
Wlos et al.

(10) Patent No.: US 7,275,957 B1
(45) Date of Patent: Oct. 2, 2007

(54) AXIAL COMPRESSION ELECTRICAL CONNECTOR FOR ANNULAR CORRUGATED COAXIAL CABLE

(75) Inventors: James J. Wlos, Crete, IL (US); John Dykstra, Tinley Park, IL (US); Joon Lee, Bolingbrook, IL (US); Jeffrey Paynter, Momence, IL (US)

(73) Assignee: Andrew Corporation, Westchester, IL (US)

( * ) Notice: Subject to any disclaimer, the term of this patent is extended or adjusted under 35 U.S.C. 154(b) by 0 days.

(21) Appl. No.: 11/277,164

(22) Filed: Mar. 22, 2006

(51) Int. Cl.
*H01R 9/05* (2006.01)

(52) U.S. Cl. ..... 439/583

(58) Field of Classification Search ..... 439/583, 439/584, 578, 429
See application file for complete search history.

(56) References Cited

U.S. PATENT DOCUMENTS

| | | | | |
|---|---|---|---|---|
| 3,181,194 | A * | 5/1965 | Dykin et al. | 15/250.02 |
| 4,046,451 | A | 9/1977 | Juds et al. | |
| 5,154,636 | A | 10/1992 | Vaccaro et al. | |
| 5,354,217 | A | 10/1994 | Gabel et al. | |
| 5,595,502 | A | 1/1997 | Allison | |
| 5,938,474 | A * | 8/1999 | Nelson | 439/583 |
| 5,993,254 | A | 11/1999 | Pitschi et al. | |
| 6,133,532 | A * | 10/2000 | Lundback et al. | 174/88 C |
| 6,217,384 | B1 | 4/2001 | Strasser et al. | |
| 6,267,621 | B1 * | 7/2001 | Pitschi et al. | 439/584 |
| 6,383,019 | B1 | 5/2002 | Wild | |
| 6,386,915 | B1 | 5/2002 | Nelson | |
| 6,607,398 | B2 | 8/2003 | Henningsen | |
| 6,951,481 | B2 * | 10/2005 | Dykstra et al. | 439/578 |
| 6,994,587 | B2 * | 2/2006 | Buenz et al. | 439/578 |
| 2005/0176293 | A1 * | 8/2005 | Khemakhem et al. | 439/578 |

* cited by examiner

*Primary Examiner*—Tulsidas C. Patel
*Assistant Examiner*—Phuongchi Nguyen
(74) *Attorney, Agent, or Firm*—Babcock IP, PLLC

(57) ABSTRACT

An electrical connector having a longitudinal axis with interface and cable ends for coaxial cable having an annular corrugated solid outer conductor. The connector having a body and an interface joined in an interference fit along the longitudinal axis of the connector. A spring finger ring within a bore of the body is rigidly connected to the body. The spring finger ring having a plurality of spring fingers extending towards an connector end; the spring fingers having an inward projecting bead at the connector end. The spring fingers positioned opposite an outer conductor groove open to the cable end, the outer conductor groove proximate the cable end of the interface.

20 Claims, 4 Drawing Sheets

AXIAL COMPRESSION ELECTRICAL CONNECTOR FOR ANNULAR CORRUGATED COAXIAL CABLE

BACKGROUND OF INVENTION

1. Field of the Invention

The invention relates to an electrical connector. More particularly the invention relates to an electrical connector installable upon an electrical cable having an annular corrugated outer conductor by application of axial compression without disassembly of the connector.

2. Description of Related Art

Connectors for corrugated outer conductor cable are used throughout the semi-flexible corrugated coaxial cable industry.

Previously, connectors have been designed to attach to annular corrugation outer conductor coaxial cable using mechanical compression via threaded connections between a body and an interface operable to clamp a leading edge of the outer conductor. Typically, the clamping is made against a clamping surface of the interface that is beveled to match the angle of a flared leading edge of the outer conductor. Clamping the leading edge of the outer conductor against the clamping surface is a thrust washer or the like, usually disassociated from the body to prevent twisting or tearing of the leading edge(s) of the outer conductor and or spring finger(s) as the body and interface are rotated with respect to each other.

Spring finger rings with a plurality of spring fingers tipped with an inward projecting bead at the end of each spring finger have been used as the thrust washer. The spring fingers deflecting over the leading edge of the outer conductor and settling into the first corrugation trough, where the inward projecting beads can then clamp against the back side of the outer conductor leading edge. To allow the spring finger ring to be rotationally disassociated from the body, a series of retaining grooves, steps and or shoulders have previously been applied, resulting in a connector requiring extensive machining steps during manufacture and having a significantly increased body diameter and overall weight.

Competition within the cable and connector industry has increased the importance of minimizing installation time, required installation tools, and connector manufacturing/materials costs. Also, competition has focused attention upon ease of use, electrical interconnection quality and connector reliability.

Therefore, it is an object of the invention to provide an electrical connector and method of installation that overcomes deficiencies in such prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
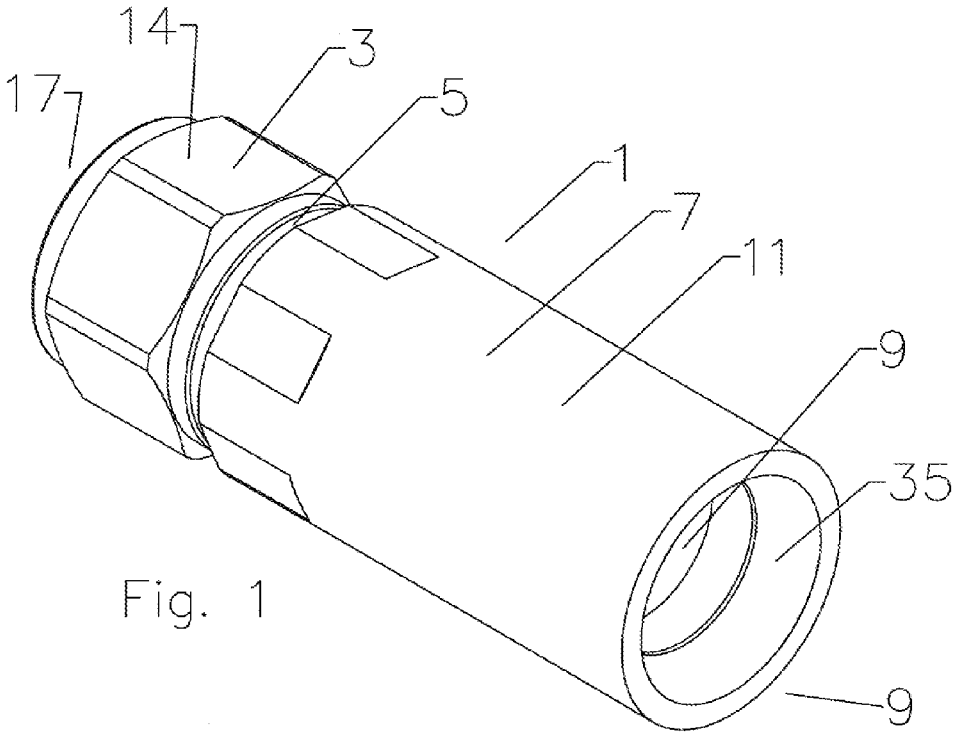
FIG. 1 is an external isometric view of a connector according to a first embodiment of the invention.
Figure 2:
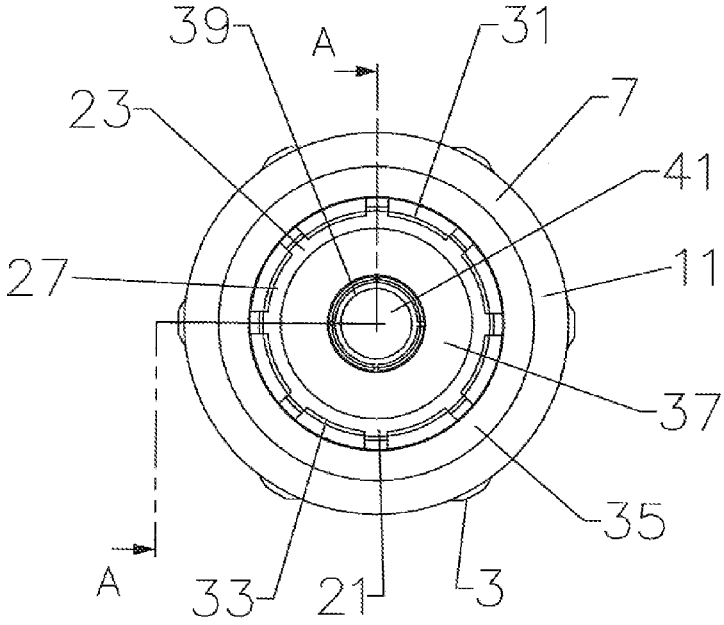
FIG. 2 is a cable end view of FIG. 1.

The inventor(s) have recognized that the prior threaded spring finger connectors require extensive machining operations upon the body, interface and thrust washer or spring finger ring during manufacture to generate the interconnection threads and or multiple guide grooves/steps and or shoulders which rotatably retain the thrust washer or spring finger ring within the body.

Also, the inventors have recognized that prior connectors have typically been machined from solid metal bar stock resulting in significant materials costs. Expanded connector body dimensions required to provide suitable tightening tooling surfaces, strength for threaded interconnect surfaces as well as to rotatably enclose the thrust washer, spring finger ring or the like further increases the materials requirements and installation difficulties.

The invention will be described in detail with respect to FIGS. 1-7 in a standard Type-N connector interface for use with annular corrugated solid outer conductor coaxial cable. One skilled in the art will appreciate that the invention, as will be discussed herein below, is similarly applicable to other standard or proprietary connector interface(s).

A connector 1 comprises a coupling nut 3 surrounding an interface 5 which mates to a body 7. To reduce metal materials requirements and decrease the overall weight of the connector 1, the body 7 may be formed with a body inner portion 9 and a body overmolding 11. Similarly, the coupling nut 3 may be formed with a coupling nut inner portion 13 and a coupling nut overmolding 14. The body and coupling nut overmolding(s) 11, 14 may be a polymeric material such as polycarbonate or other plastic injection molded about the corresponding inner portion. A textured surface treatment 16 may be applied to the metal inner body and coupling nut portions 9, 13 to improve adhesion with the overmolding.

Figure 3:
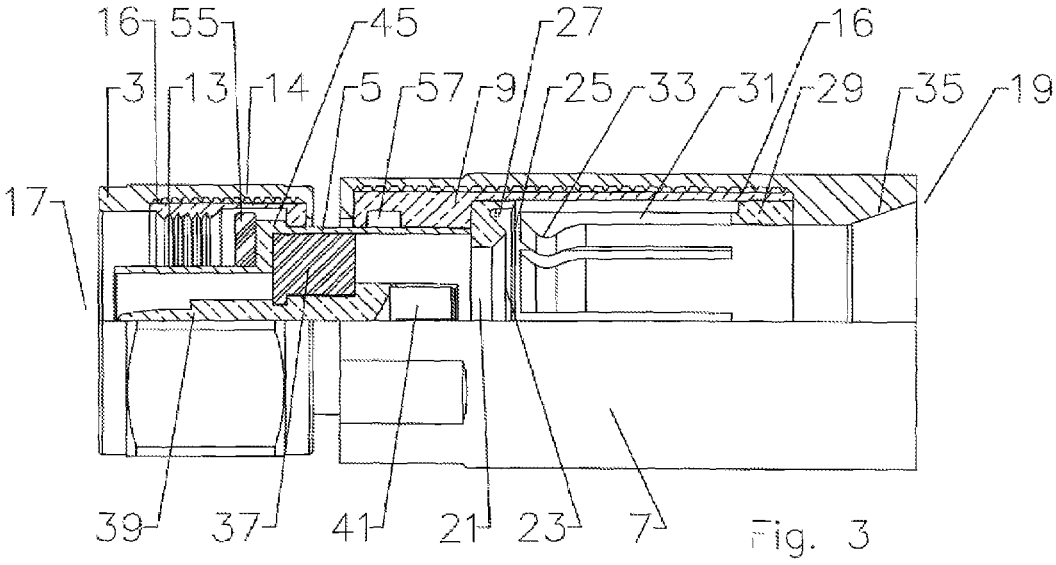
FIG. 3 is a combination external side view and partial cross sectional view of FIG. 1, along line A-A.

As shown in FIG. 3, a connector 1 according to the invention is ready for installation upon a cable 15 without any assembly/disassembly requirements. The body inner portion 9 and interface 5 are coupled together in an interference fit along the connector end 17 bore of the body inner portion 9 and a corresponding cable end 19 outer diameter of the interface 5. Within the connector 1 a flare ring 21 is retained by an initial interference fit within the body 7 and adjacent to a cable end 19 of the interface 5. The flare ring 21 has a beveled flare seat 23 and a retaining lip 25 that form an outer conductor groove 27 open to the cable end 19 of the connector 1. Alternatively, the beveled flare seat 23 and retaining lip 25 that form the outer conductor groove 27 may be formed in the cable end of the interface 5, eliminating the flare ring 21.

Figure 4:
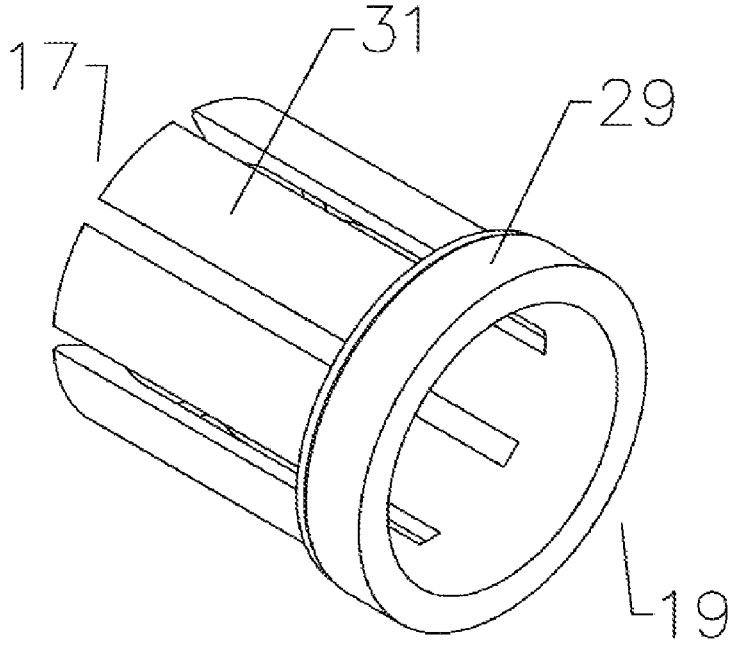
FIG. 4 is a cable end isometric view of a spring finger ring.
Figure 5:
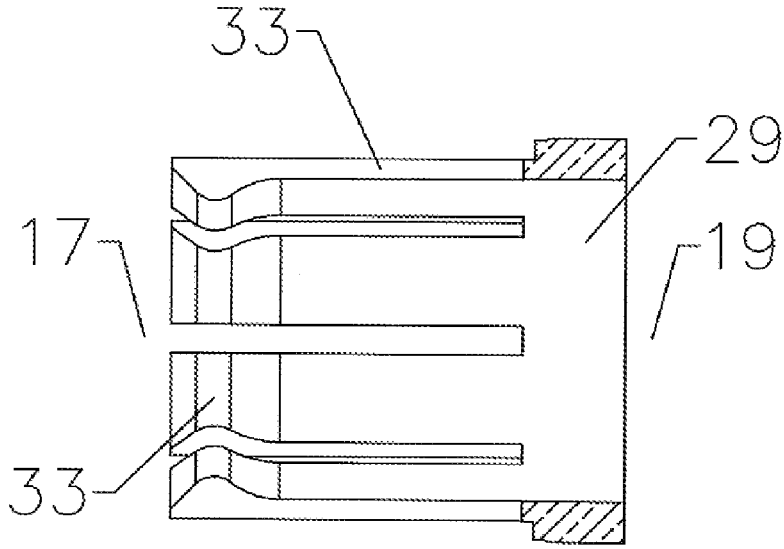
FIG. 5 is a cross sectional side view of FIG. 4.

A spring finger ring 29, for example as shown in FIGS. 4 and 5, is located within the body 7 bore coupled to the cable end 19 of the body inner portion 9. The spring finger ring 29 has a plurality of spring finger(s) 31 extending towards the connector end 17. Each of the spring finger(s) 31 has an inward projecting bead 33 at the tip. The body overmolding 11 at the cable end 19 may be formed extending inward to an inner radius of the spring finger ring 29 assisting with the retention of the spring finger ring 29 within the body inner portion 9 bore. Also, an angled face formed in the body overmolding 11 at the cable end 19 may provide a guide surface 35 for the insertion of the cable 15 into the connector 1.

The interface 5 is adapted according to the type of connection interface desired. If needed, an insulator 37 may be used to retain a center pin 39 coaxially within the interface 5. A spring basket 41 at the cable end 19 of the center pin 39 is inwardly biased to electrically contact and retain an inner conductor 41 of the cable 15 upon insertion.

The coupling nut 3 is rotatably retained around the outer diameter of the interface 5 between an outwardly projecting retention shoulder 45 at the connector end 17 and the body 7 at the cable end 19. In the first embodiment, the coupling nut inner portion 13 is threaded according to the specification of the Type N interface.

Figure 6:
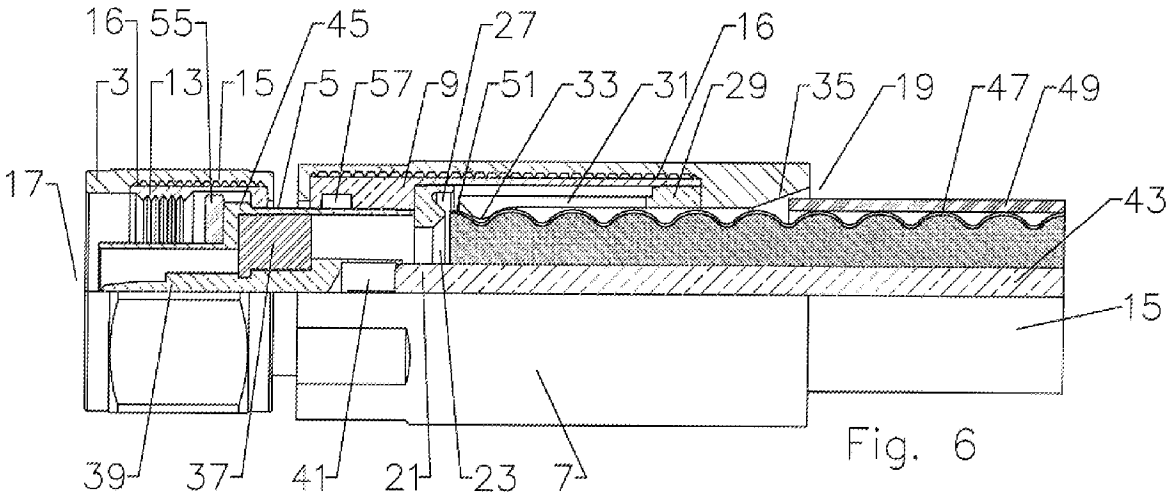
FIG. 6 is a combination external side view and partial cross sectional view of FIG. 1, along line A-A, after coaxial cable insertion and before axial compression.

A connector 1 according to the invention is mounted according to the following procedure. A coaxial cable 15 is stripped back to expose the desired length of inner conductor 43 from the outer conductor 47 and the outer sheath 49, if any, is removed from a desired length of the outer conductor 47. The cable 15 is then inserted into the cable end 19 of the connector 1. Because the flare ring 21 is retained adjacent the cable end 19 of the interface 5 by the initial interference fit with the inner body portion 9, as a leading edge 51 of the outer conductor 47 contacts the inward projecting bead(s) 33 of the spring finger(s) 31, the spring finger(s) 31 are clear of the flare ring 21 retaining lip 25, allowing the spring finger(s) 31 to be deflected outwards to allow the leading edge 51 of the outer conductor 47 to pass. As shown in FIG. 6, as the leading edge 51 of the outer conductor 57 passes the inward projecting bead(s) 33 of the spring finger(s) 31, the spring finger(s) 31 return to a ready state, resting in the first corrugation behind the leading edge 51 of the outer conductor 47. At the same time, as shown in FIG. 6, the inner conductor 43 has been advanced to a position just short of entry into the spring basket 41 of the center pin 39, if present.

To finally secure the connector 1 and cable 15 together, axial compression is applied. An axial compression tool is attached, abutting the cable end 19 of the body 7. The axial compression tool is used to apply an axial compression force between the cable end 19 of the connector 1 and the interface 5, along the longitudinal axis of the connector 1 and cable 15. As the axial compression force is applied, the preliminary interference fit between the interface 5 and the body 7 shifts to move the interface 5 and the flare ring 21 abutting the interface 5 towards the cable end 19, into a final interference fit. As the body and interface move relative to one another the retaining lip 25 of the flare ring 21 moves towards and overlaps the connector end 17 of the spring finger(s) 31 preventing deflection up and away from the leading edge 51 and or flare seat 23. Thus, the cable 15 is retained within the bore by the spring fingers. As the flare ring 21 moves towards the cable end 19, the leading edge 51 of the outer conductor 47 engages the flare seat 23 and is flared up and away from the inner conductor 43 along the flare seat 23. Insulation 53 between the inner and outer conductor(s) 43, 47 of the cable 15 is deformed downward and away from the outer conductor 47 providing a metal to metal contact between the flare seat 23 and the leading edge 51 of the outer conductor 47 around a 360 degree circumference. At the same time, the inner conductor 43 is advanced into the spring basket 41 of the center pin 39, creating a secure connection between the inner conductor 43 and the center pin 39.

Figure 7:
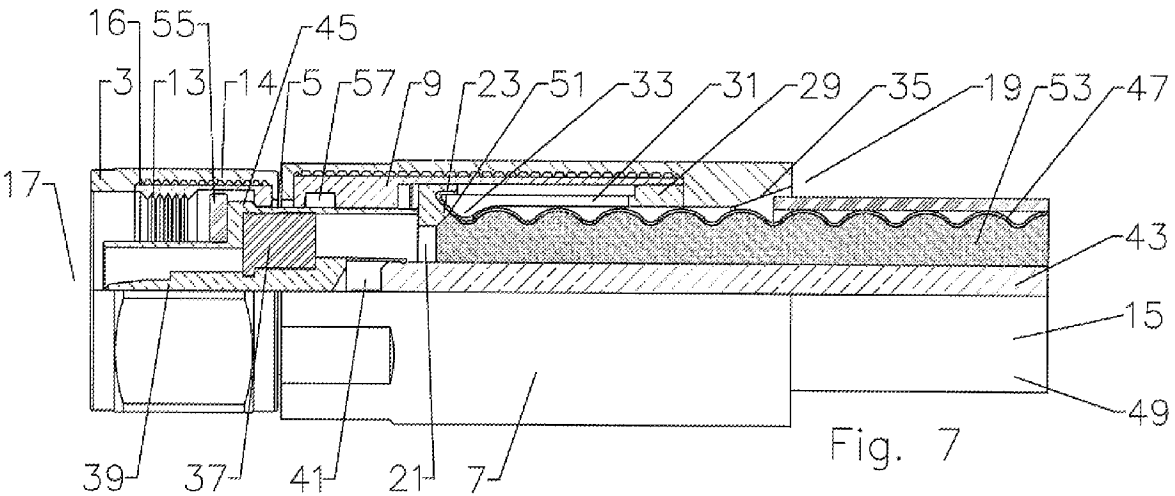
FIG. 7 is a combination external side view and partial cross sectional view of FIG. 1, along line A-A, after coaxial cable insertion and axial compression.

As shown in FIG. 7, when the axial compression is complete, the interference fit between the body 7 and the interface 5 has been shifted such that the flare ring 21 and spring finger(s) 31 are securely clamped against front and back sides of the flared leading edge 51 of the outer conductor 47 and the inner conductor 43 is securely retained within the spring basket 41 of the center pin 39, if present. The body 7 has moved closer to the coupling nut 3, but still leaves enough room for the coupling nut 3 to be rotatable for interconnection with a desired connection interface.

A plurality of compressible and or deformable sealing gaskets, for example rubber or silicon o-rings, may be located around and within the connector 1 to environmentally seal the connecting surface(s). An connector interface gasket 55 may be located seated upon the interface 5, to seal an interconnection between the connector 1 and a mating connector. An interface gasket groove 57 may be formed, for example along a bore of the body 7 to seat a gasket (not shown) to seal the interference fit between the interface 5 and the body 7. Also, a cable gasket (not shown) may be seated in a corresponding annular corrugation of the outer conductor 43 between the body overmolding 11 and the outer conductor 47.

Upon a review of this Specification, one skilled in the art will appreciate that the various interference fit surfaces described herein may be oriented in alternative overlapping surface configurations. Further, the connector interface may be a proprietary configuration or a standard interface, for example, Type F, SMA, DIN, Type N or BNC. Also, additional features may be included, for example, to provide seating surfaces for specific axial compression apparatus.

The invention provides an environmentally sealed connector 1 with improved installation characteristics. Depending upon the material characteristics and dimensions of the particular cable 15 used, the connector 1 may be quickly and securely attached using a compact hand tool. Because threading between the body 7 and interface 5 has been eliminated by configuration for mounting via axial compression, the body 7 and interface 5 do not need to be sized to support exterior wrench flats and or threads between the interface 5 and the body 7. Therefore, even with larger diameter cable(s) 15, the largest body 7 diameter may be easily configured to be less than the largest coupling nut 3 diameter which enables the installation of connectors and cables according to the invention in small spaces and or alongside each other in closer proximity. Because the factory pre-assembled connector 1 does not require any disassembly or other preparation before mounting upon a cable, the opportunity for losing or damaging an essential part of the connector 1 has been eliminated. In addition to reduced wall thickness requirements, through the application of overmolded polymeric outer surfaces and body 7 extensions, the connector 1 has significantly reduced weight.

The invention also provides significant manufacturing and materials cost efficiencies. The application of polymeric overmolding for outer surfaces significantly reduces the metal content of the connector 1 while the inner portions of the body 7 and coupling nut 3 maintain a fully contiguous metallic electrical enclosure with suitable levels of strength. Because the invention applies axial compression to attach the connector 1 to a cable, threading is eliminated with respect to the clamping of the outer conductor. This allows the spring finger ring 29 to be permanently mounted within the body 7 without rotatability, greatly reducing the number of threading, shoulder, step and or groove machining steps required during manufacture. Further, the greatly simplified surfaces of the body 7, interface 5 and or spring finger ring 29 according to the invention creates an opportunity for connector 1 component manufacture using cost effective metal injection molding technologies.

TABLE OF PARTS 1 connector
3 coupling nut
5 interface
7 body
9 body inner portion
11 body overmolding
13 coupling nut inner portion
14 coupling nut overmolding
15 cable
16 surface treatment
17 connector end
19 cable end
21 flare ring
23 flare seat
25 retaining lip
27 outer conductor groove
29 spring finger ring
31 spring finger
33 inward projecting bead
35 guide surface
37 insulator
39 center pin
41 spring basket
43 inner conductor
45 retention shoulder
47 outer conductor
49 sheath
51 leading edge
53 insulation
55 connector interface gasket
57 interface gasket groove Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. An electrical connector, having a longitudinal axis with an connector end and a cable end, for annular corrugated solid outer conductor coaxial cable, comprising:

a body and an interface joined in an interference fit along the longitudinal axis of the connector;

a spring finger ring within a bore of the body, rigidly connected to the body;

the spring finger ring having a plurality of spring fingers extending towards the connector end;

the spring fingers having an inward projecting bead at the connector end; and a flare ring within the bore having a retaining lip and a flare seat forming an outer conductor groove open to the cable end, the flare ring abutting the cable end of the interface.

2. The connector of claim 1, wherein the flare ring is retained abutting the cable end of the interface by a preliminary interference fit against the bore of the body.

3. The connector of claim 1, further including a center pin coaxially supported within a bore of the interface by an insulator, the center pin having a spring basket at the cable end.

4. The connector of claim 1, further including an interface gasket groove in the bore of the body, between the interference fit of the body and the interface.

5. The connector of claim 1, further including a coupling nut rotatably retained upon an outer diameter of the interface by a retention shoulder at the connector end and by the body at the cable end.

6. The connector of claim 5, wherein the coupling nut is formed from a metallic coupling nut inner portion and a polymeric coupling nut overmolding covering an outer diameter, the cable end and the connector end.

7. The connector of claim 1, wherein the body is formed from a metallic body inner portion and a polymeric body overmolding covering an outer diameter, the cable end and the connector end.

8. The connector of claim 7, wherein the body overmolding extends from the cable end of the body along the longitudinal axis, the bore continuing through the overmolding having a guide surface with an increasing inner diameter towards the cable end.

9. An electrical connector, having a longitudinal axis with an connector end and a cable end, for annular corrugated solid outer conductor coaxial cable, comprising:

a body and an interface joined in an interference fit along the longitudinal axis of the connector;

a spring finger ring within a bore of the body, rigidly connected to the body;

the spring finger ring having a plurality of spring fingers extending towards the connector end;

the spring fingers having an inward projecting bead at the connector end; and a retaining lip and a flare seat forming an outer conductor groove open to the cable end;

the outer conductor groove proximate the cable end of the interface.

10. The connector of claim 9, wherein via application of an axial compression force between the cable end and the connector end along the longitudinal axis, the body and the interface are movable along the interference fit to clamp a leading edge of the solid outer conductor between the spring fingers and the outer conductor groove.

11. The connector of claim 9, wherein the body has a metallic body inner portion with a bore and a polymeric body overmolding covering an outer diameter of the body inner portion; the body overmolding extending from the cable end of the body along the longitudinal axis, the bore extending from the body through the body overmolding and having a guide surface with an increasing inner diameter towards the cable end.

12. The connector of claim 9, wherein the outer conductor groove is formed in a flare ring adjacent to the cable end of the interface.

13. The connector of claim 9, wherein the outer conductor groove is formed in a flare ring adjacent to the cable end of the interface; the flare ring having a preliminary interference fit against the bore.

14. The connector of claim 9, wherein the cable is insertable within the bore from the cable end;

the spring fingers deflectable to allow passage of a leading edge of the solid outer conductor past the inward projecting bead(s).

15. The connector of claim 9, further including a center pin coaxially supported within a bore of the interface by an insulator, the center pin having a spring basket at the cable end.

16. The connector of claim 9, wherein the rigid connection between the spring finger ring and the body is via an interference fit.

17. The connector of claim 9, further including an interface gasket groove formed in the bore of the body between the cable end and the connector end of the interference fit.

18. The connector of claim 9, further including a coupling nut rotatably retained upon an outer diameter of the interface by a retention shoulder at the connector end and the connector end of the body.

19. The connector of claim 18, wherein a maximum outer diameter of the body is less than a maximum outer diameter of the coupling nut.

20. An electrical connector, having a longitudinal axis with an connector end and a cable end, for annular corrugated solid outer conductor coaxial cable, comprising:

a body having a metallic body inner portion with a bore and a polymeric body overmolding covering an outer diameter, the cable end and the connector end of the body inner portion;

the body overmolding extending from the cable end of the body along the longitudinal axis, the bore extending from the body through the body overmolding having a guide surface with an increasing inner diameter towards the cable end;

an interface joined in an interference fit with the body along the longitudinal axis of the connector;

a coupling nut rotatably retained upon an outer diameter of the interface by a retention shoulder at the connector end and by the body at the cable end;

the coupling nut having a metallic coupling nut inner portion and a polymeric coupling nut overmolding covering an outer diameter of the coupling nut inner portion, the cable end and the connector end of the coupling nut inner portion;

a spring finger ring within the bore of the body, rigidly connected to the body;

the spring finger ring having a plurality of spring fingers extending towards an connector end;

the spring fingers having an inward projecting bead at the connector end; and a flare ring within the bore having a retaining lip and a flare seat forming an outer conductor groove open to the cable end, the flare ring abutting the cable end of the interface, retained by a preliminary interference fit against the bore of the body.

* * * * *